US008061645B2

(12) United States Patent
Granger

(10) Patent No.: US 8,061,645 B2
(45) Date of Patent: Nov. 22, 2011

(54) DISPOSABLE END PIECE FOR A ROLL OF WIPING MATERIAL AND APPARATUS FOR DISPENSING WIPING MATERIAL USING ONE SUCH END PIECE

(76) Inventor: Maurice Granger, Saint Priest en Jarez (FR)

( * ) Notice: Subject to any disclaimer, the term of this patent is extended or adjusted under 35 U.S.C. 154(b) by 12 days.

(21) Appl. No.: 12/517,648

(22) PCT Filed: Dec. 11, 2007

(86) PCT No.: PCT/FR2007/052474

§ 371 (c)(1),
(2), (4) Date: Jun. 4, 2009

(87) PCT Pub. No.: WO2008/078036

PCT Pub. Date: Jul. 3, 2008

(65) Prior Publication Data

US 2010/0078515 A1 Apr. 1, 2010

(30) Foreign Application Priority Data

Dec. 11, 2006 (FR) ..... 06 55422

(51) Int. Cl.
*B65H 75/18* (2006.01)

(52) U.S. Cl. ..... 242/599.3; 242/596.7; 242/597.6

(58) Field of Classification Search ..... 242/578.2, 242/613.5, 578, 578.3, 608, 608.2, 594, 594.6, 242/597.5, 597.6, 599.4, 599.3, 596, 596.7
See application file for complete search history.

(56) References Cited

U.S. PATENT DOCUMENTS

| | | | | |
|---|---|---|---|---|
| 4,015,788 | A * | 4/1977 | O'Connor | 242/598.4 |
| 4,307,639 | A * | 12/1981 | DeLuca | 83/337 |
| 5,255,865 | A * | 10/1993 | Buell et al. | 242/613 |
| 5,997,195 | A * | 12/1999 | Burgin | 400/242 |
| 6,241,180 | B1 * | 6/2001 | Potter | 242/571.5 |
| 6,745,974 | B2 * | 6/2004 | Nelson | 242/573.4 |

(Continued)

FOREIGN PATENT DOCUMENTS

WO WO2005/094652 A 10/2005

OTHER PUBLICATIONS

The International Search Report for PCT/FR2007/052474, dated Oct. 23, 2008.

*Primary Examiner* — William A Rivera
(74) *Attorney, Agent, or Firm* — Heslin Rothenberg Farley & Mesiti P.C.

(57) ABSTRACT

The end piece for a roll of wiping material comprises a cylindrical bearing surface tightly fitted into a core that supports the roll, a transverse flange that protrudes from the cylindrical bearing surface and rests against an opposite-facing surface of the core and the roll, and an axially extending neck that has a head with an internal hole and a hollowed-out section forming a guide groove. The hollowed-out section is located between the head and the cylindrical bearing surface. The head and part of the hollowed-out section are deformable and internally provided with a hole that creates deliberate fragility facilitating, by crushing, their deformation as the core and the end piece are extracted from an accommodating side plate. After the core and end piece have been extracted, the head of the end piece is, in its final state, permanently deformed and cannot be reused.

7 Claims, 5 Drawing Sheets

U.S. PATENT DOCUMENTS

| | | | | |
|---|---|---|---|---|
| 7,364,112 | B1 * | 4/2008 | Formon | 242/599.4 |
| 7,780,112 | B2 * | 8/2010 | Granger et al. | 242/599.3 |
| 2006/0226279 | A1 * | 10/2006 | Paukov | 242/609 |
| 2008/0302810 | A1 * | 12/2008 | Friesen | 221/45 |
| 2009/0001213 | A1 * | 1/2009 | Looft | 242/599 |
| 2009/0057169 | A1 * | 3/2009 | Kruchoski et al. | 206/225 |
| 2010/0025519 | A1 * | 2/2010 | Granger et al. | 242/590 |

* cited by examiner

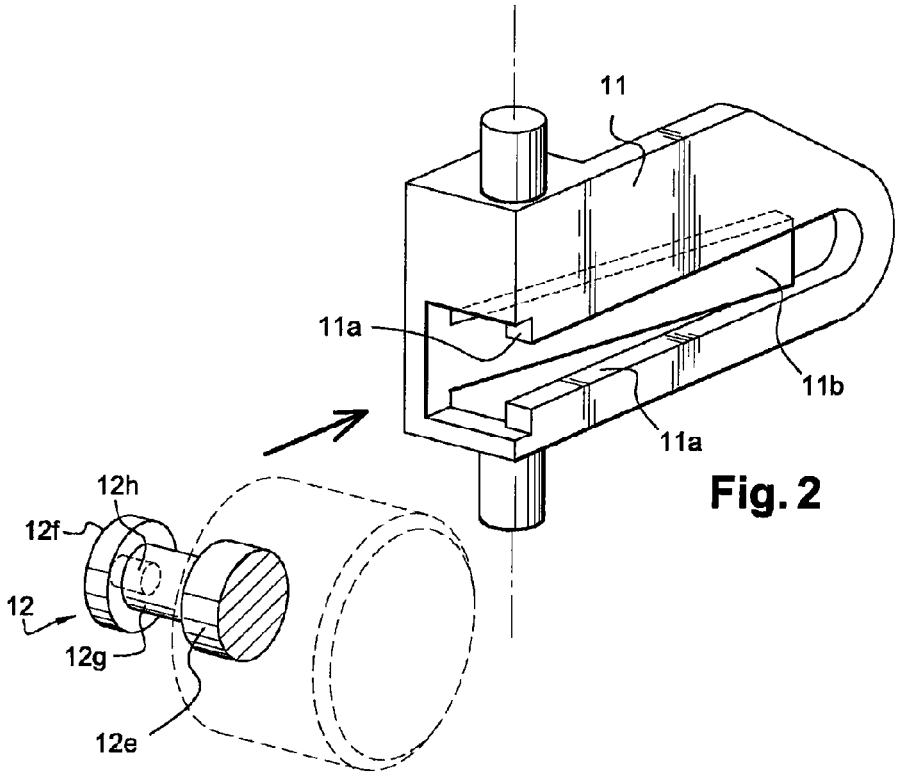
Fig. 2
Fig. 3
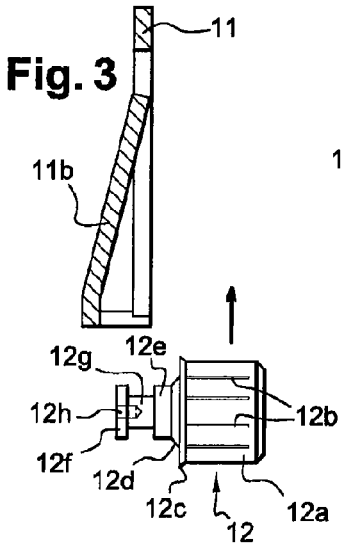
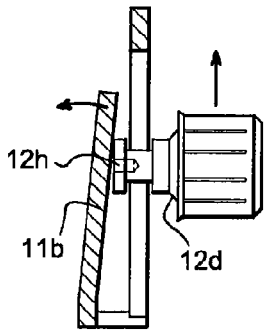
Fig. 4
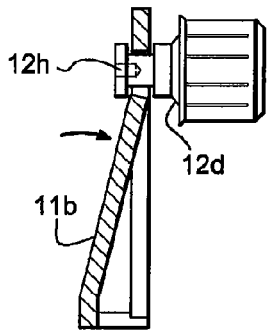
Fig. 5

DISPOSABLE END PIECE FOR A ROLL OF WIPING MATERIAL AND APPARATUS FOR DISPENSING WIPING MATERIAL USING ONE SUCH END PIECE

CROSS REFERENCE TO RELATED APPLICATIONS

This application is a national stage filing under section 371 of International Application No. PCT/FR2007/052474 filed on Dec. 11, 2007, and published in French on Jul. 3, 2008 as WO 2008/078036 and claims priority of French application No. 0655422 filed on Dec. 11, 2006, the entire disclosure of these applications being hereby incorporated herein by reference.

BACKGROUND ART

The invention relates to the technical field of apparatus for dispensing basewad papers with automatic or non-automatic cutting. These dispensing apparatuses can have different applications such as hand wipes, toilet paper or similar applications.

The Applicant has developed numerous apparatuses for dispensing wiping material which comprise a housing (1) with a protective cover (2) inside which there is, mounted on support side plates (3), a drum (5) that accommodates an internal cutting device (not shown) which is actuated by the strip of material being pulled by the user from a roll of material (6). The latter may be suspended from the side plates or rest directly on the drum. The roll of wiping material which is mounted on the support side plates (4) is tightly wound around a core (7). The latter accommodates, on at least one of its ends, an end piece (8) capable of positioning itself on the opposite side plate (4) of the housing, the other end of the core positioning itself on the opposite side plate which is designed with an accommodating bearing surface (9) that is shaped during moulding or located on a flexible tab (10) that is articulated relative to its support side plate (4). These end pieces are generally made in cylindrical form with a protruding transverse flange that presses against the opposite-facing surface of the core and the roll, an internal cylindrical part being tightly fitted into the core, the end piece also having forwardly an axially extending neck which fits into an indentation of the support side plate in question.

Depending on the developed versions operated by the Applicant's licensees, the end piece has a simple straight neck or it may have, along the length of said neck, a head at its end and a cylindrical bearing surface adjacent to the flange. It may also comprise a hollowed-out area forming a groove and guide path as shown in FIG. 2. In this case, said end piece is made to cooperate with an articulated guide (11) separately mounted on support plate (4) which supports the roll and facilitates insertion of the roll of wiping material and its retention by movement of the guide in opposition to an elastic return means which is not shown. The support guide has projections (11*a*) formed internally on the walls of its opening through which the end piece passes and is inserted. Such an arrangement is described in the Applicant's PCT Patent WO 2005/094652.

This document also describes the possibility of designing the guide with opposite-facing recesses either side of the guide path forming a groove. In this embodiment, the core accommodates a single end piece at one end and cooperating with above-mentioned support side plate, whereas the other end of the core centres itself on a bearing surface provided on the opposite-facing side plate. The arrangement of opposite-facing recesses, as stated above, enables downward swiveling of the core when the roll of material is exhausted. In this case, the core and the end piece fitted on its end can be recovered and may or may not be reused or disposed of without there being any modification to the appearance and characteristics of the core and the end pieces.

The problem to be solved is that of end pieces possibly being reused by persons or competitors who may recondition them on cores with rolls of wiping material that do not originate from the original firm that laid down the specifications for the apparatuses for dispensing wiping materials in question.

In an attempt to deal with this situation, the Applicant has developed improvements of the parts that accommodate the end piece in the apparatus, i.e. on the side plates of the housing or on a swiveling support guide described in the Applicant's Patent PCT 2005/094652. Another technical solution is described in French Patent No. 2879090, for a locked end piece described and devised by the Applicant. This is a device for locking the end piece which prevents it being removed by simply withdrawing it.

In practice, this solution is expensive to implement and requires an additional number of parts in order to obtain the above-mentioned function. In addition, it does not solve the problem of possible reuse of the end piece which remains intact in terms of its shape and structure.

End pieces for rolls of wiping materials as disclosed in U.S. Pat. No. 4,671,466, and German Patent 19723076, are also known. These end pieces are not at all suitable for solving the Applicant's problem and their head part has a rigid configuration despite the presence of an internal hole because their function is unconnected with the problem in question.

BRIEF SUMMARY OF INVENTION

The Applicant's approach was therefore to rethink this problem with a view to providing the operator of the apparatus for dispensing wiping material with its own end pieces that cannot be reused by unscrupulous competitors.

The solution devised by the Applicant is the result of an unexpected approach that is contrary to all considerations of wastage, said solution involving self-destruction of the end pieces when the end of the roll is reached.

In other words, the solution adopted by the Applicant aims to make the end piece in question unusable by competitors and even by the Applicant itself once the roll has been finished up. In this respect the Applicant's solution is quite unexpected and flies in the face of the classic objectives of mass produced products and environmental requirements in terms of wastage.

The solution devised by the Applicant is applicable to any type of apparatus for dispensing wiping material which uses at least one end piece inserted into the core which supports the roll of wiping material.

According to a first aspect of the invention, the end piece for a roll of wiping material of the type comprising a cylindrical bearing surface tightly fitted into the core that supports the roll with a transverse flange that protrudes from the cylindrical bearing surface and rests against the opposite-facing surface of the core and the roll and an axially extending neck that has a head with an internal hole and a hollowed-out section forming a guide groove, said hollowed-out section being located between the end head and a cylindrical bearing surface adjacent to the flange, said end piece being distinctive in that the head of the axial neck and part of the hollowed-out section forming a groove constituting the guide path are deformable and internally designed with a hole that creates deliberate fragility making it possible, by crushing their deformation at the time the core and the end piece are extracted from the accommodating side plate and in that the head of said end piece is, in its final state after the core and its end piece have been extracted, irreversibly deformed and not reusable.

These aspects and others will become apparent from the following description.

BRIEF DESCRIPTION OF THE DRAWING FIGURES

The object of the present invention is described, merely by way of example, in the accompanying drawings in which:

FIG. 2 is a partial perspective view of a profiled end piece that cooperates with an articulated guide mounted on the side plate of the apparatus.

FIGS. 3, 4 and 5 are schematic views showing the positioning of the end piece according to the invention in the support guide.

DETAILED DESCRIPTION

In order that the object of the invention may more readily be understood, the following description is given, merely by way of example, reference being made to the accompanying drawings.

Figure 1:
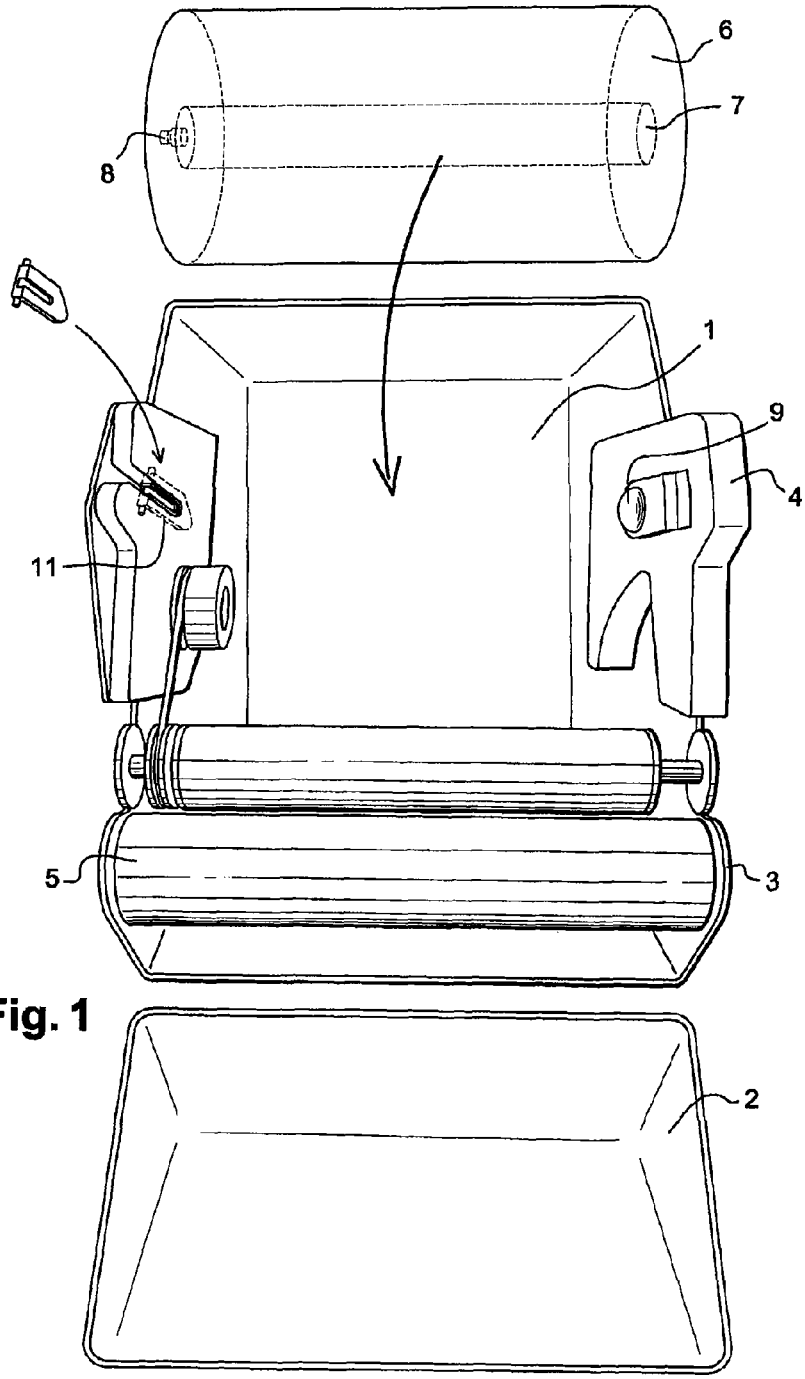
FIG. 1 is a view of an example of an apparatus for dispensing wiping material with a roll intended to be suspended relative to the drum, the roll being located on a core that accommodates at least one end piece.
Figure 7:
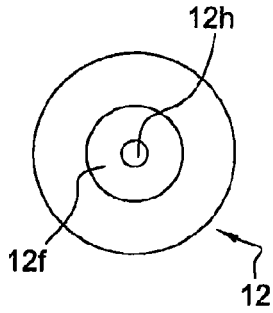
FIG. 7 is a front view of the end piece in the same situation as in FIG. 6.
Figure 6:
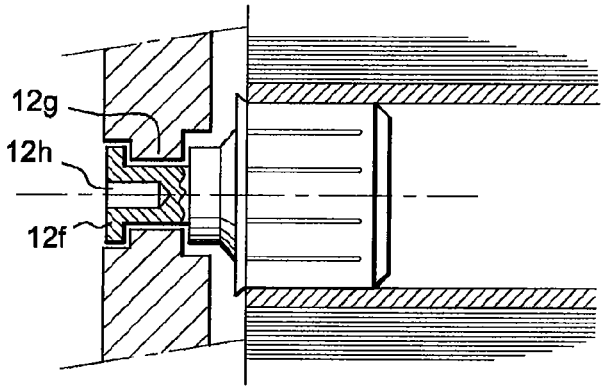
FIG. 6 is a longitudinal cross-sectional view showing the end piece according to the invention fitted in the support guide at times when it is in use.
Figure 11:
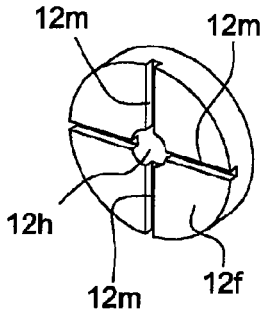
FIG. 11 is an alternative view of the head of the end piece which has a predetermined breaking point in its thickness.
Figure 8:
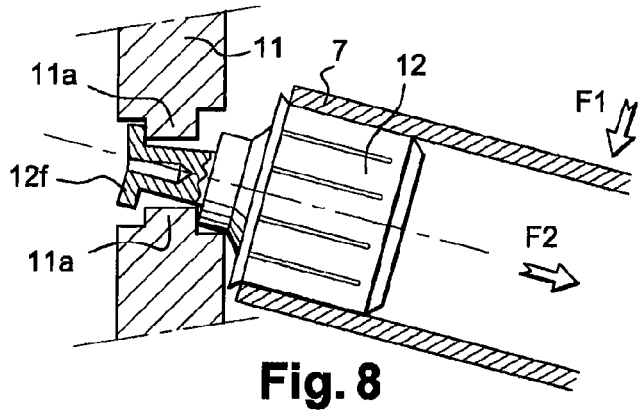
FIG. 8 is a longitudinal cross-sectional view showing swiveling of the core prior to its extraction.
Figure 9:
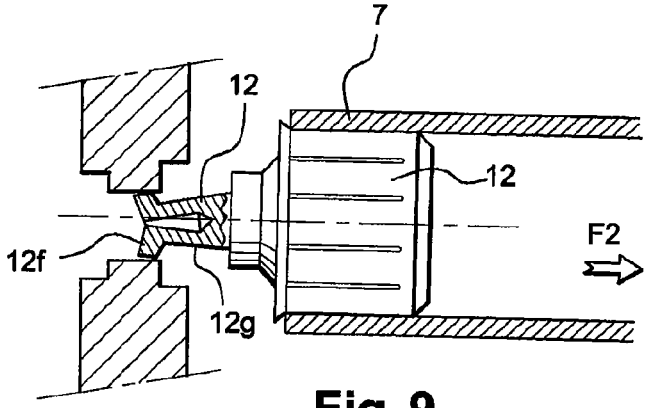
FIG. 9 is a view that complements FIG. 8 showing extraction of the core and its end piece and, because of this, deformation of the latter.

In FIGS. 6, 8 and 9, end piece (12) has a cylindrical bearing surface (12*a*) with splines (12*b*) and a transverse flange (12*c*) which fits tightly into the core. This area of the end piece which is intended to be located inside the core can be differently designed, the arrangement in the Figures merely being shown by way of example.

The front part of the end piece, i.e. that located outside the core, has beyond the transverse flange, an axial neck comprising a tapered bearing surface (12*d*) that extends as a cylindrical bearing surface (12*e*), a head (12*f*) at its end and, between these two, a hollowed-out section forming a groove (12*g*) to constitute a guide path. The presence or absence of the tapered part (12*d*) depends on the configuration of the end piece.

According to the invention, the head (12*f*) and the hollowed-out section (12*g*) forming the guide of end piece (10) are deformable and internally designed with a hole (12*h*) to create deliberate fragility, the function of which is to allow by subsequent crushing deformation of at least said head and, if applicable, the hollowed-out section when force is exerted to extract the core after closure of the roll. This deformation is made possible by the flexibility of the material of which the end piece is made and therefore the diameter and depth of the through-hole thus made.

The guide (11) illustrated in FIG. 2 or FIGS. 6, 7 and 9 is therefore designed with a slot into which the end piece is inserted with a protruding area that corresponds to the hollowed-out section (12*g*) of the end piece in order to guide it. It thus defines a constricted shape and the rear part of head (12*f*) of the end piece presses against the internal wall of said protruding area. In the normal situation shown in FIGS. 5 and 6 when there is material on the roll core, the end piece is perfectly retained with the hollowed-out part being centred around the protruding area of the guide. A tab (11*b*) capable of elastic deformation and joined to the guide maintains the end piece in position and prevents it escaping.

Figure 10:
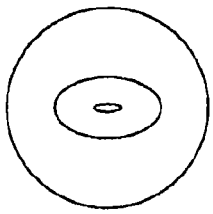
FIG. 10 is a front view of the end piece after deformation of the head.

When the roll is completely exhausted, i.e. the core is empty (FIG. 8), the core must be extracted and removed. The core is swiveled in the direction of arrow (F1) and the upper part of the deformable head of the end piece pushes against the fixed protruding part of the guide. The tensile force exerted in the direction of arrow (F2) combined with the swiveling force causes crushing of at least the head of the end piece and, if applicable, also the hollowed-out part. Hole (12*h*) allows the walls of the head of the end piece to move towards each other, thereby allowing clearance by clamping the head in the constriction or opening formed on the bottom between its protruding parts (FIG. 9). Due to the nature of the material of which the end piece and its front part are made, head (12*h*) is then irreversibly deformed with, for instance, a regular or irregular oval configuration as shown in FIG. 10, depending on the force and tensile forces exerted.

The end piece of the core can no longer be used because of deformation of its front part and this solves the problem in question. The deformation of the head of the end piece and hence its hollowed-out section thus obtained does not create any risk of cracking or breakage of the head from the body of the end piece and there are therefore no loose fragments that can remain inside the dispensing apparatus.

Without going beyond the scope of the invention, the front surface of the head of the end piece has partial cuts in its thickness in the form of a cross (12*m*) in order to facilitate bending and deformation of the head of the end piece in order to make it deliberately more fragile.

Figure 12:
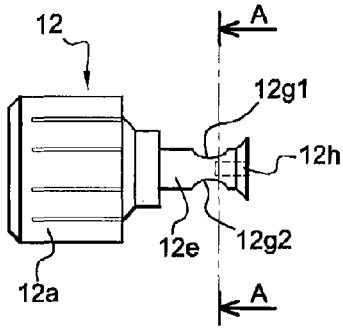
FIG. 12 is a side view of an alternative embodiment of an end piece according to the invention.

It is now time to describe the end piece variant, shown in FIG. 12, which is designed with a deformable head in order to fulfil the deformation function which involves its destruction, as referred to above, as well as another function of locking in an articulated flap associated with a support side piece of the roll of material in the dispensing apparatus.

In FIG. 12, the reference numbers used for the deformable end piece are the same, apart from the fact that hollowed-out section (12*g*) has a very particular configuration. It actually has two opposite-facing curved restrictions (12*g*1) which reduce the thickness of section (d1) to roughly 1.5, to 2, mm, whereas section (d2) in the plane which is perpendicular to it has a section which is approximately 3, to 4, mm thick. Besides facilitating deformation of the head of the end piece, this arrangement has a specific advantage when it comes to locking the end piece.

Figure 15:
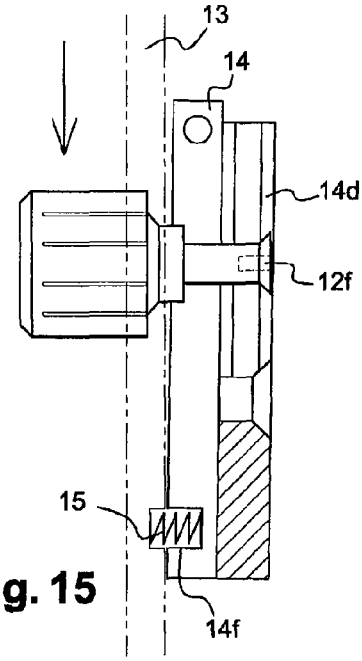
FIGS. 15 and 16 show how the end piece according to FIG. 12 is fitted in said flap thereby locking it in position.
Figure 16:
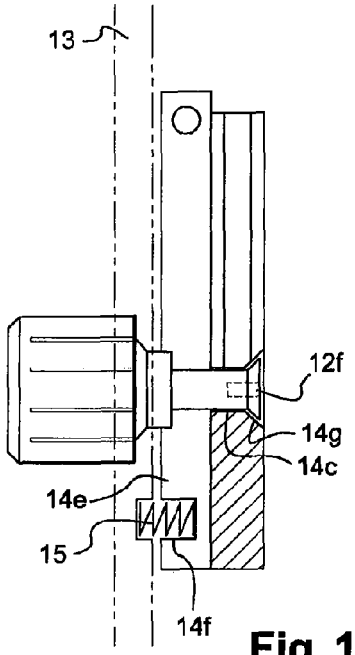
Figure 14:
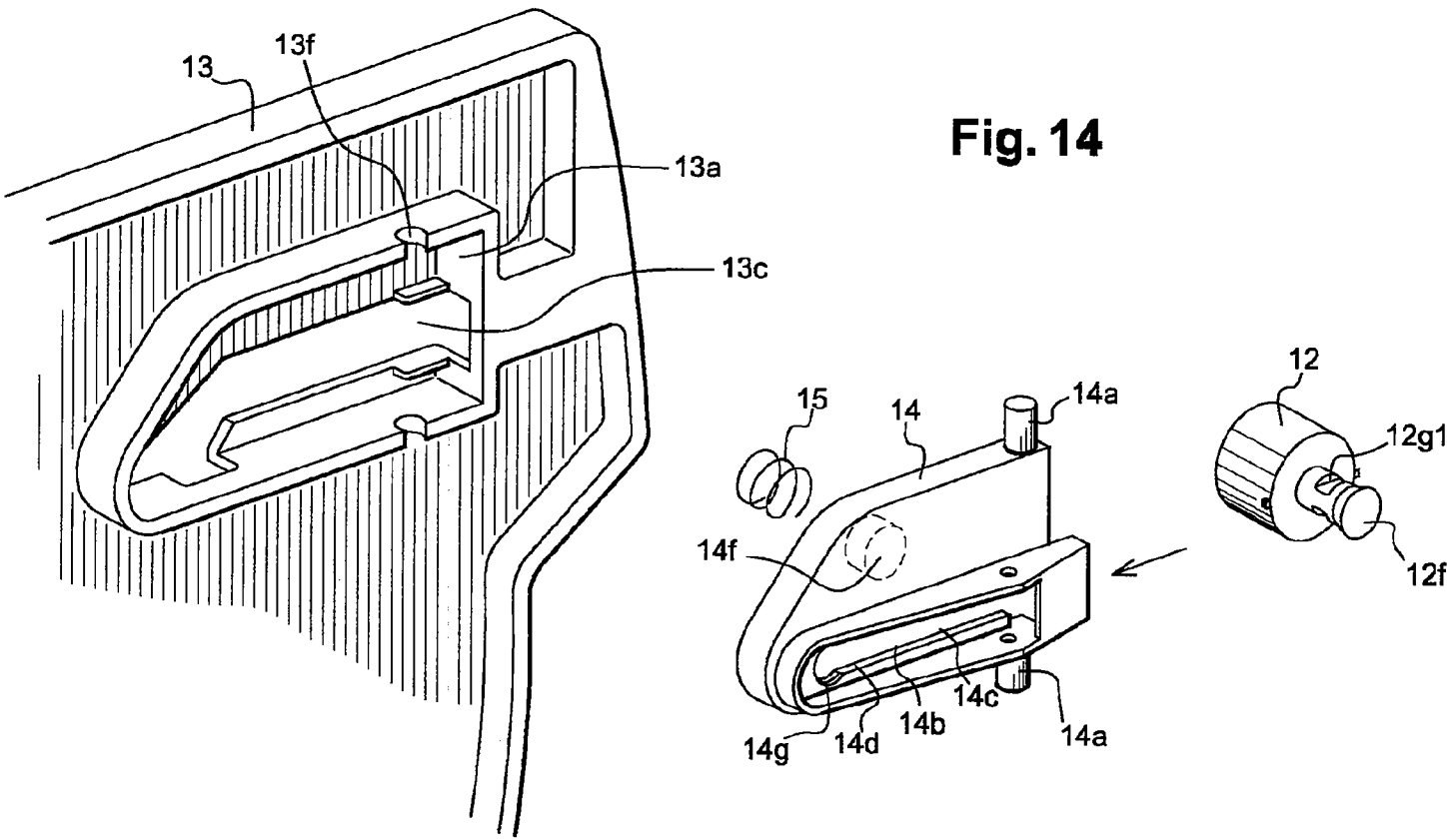
FIG. 14 is a partial exploded view of the end piece before it is mounted on a support flap fitted on the side piece that supports the roll of wiping material of the apparatus.

In contrast to using the locking tab (11*b*) shown in FIGS. 2, 3, 4 and 5, the end piece with a deformable head can be used with a device which is shown in FIGS. 14, 15 and 16. The inside part of one of the side pieces (13) which receives the roll-holder core is designed with a seat-shaped part (13*a*) delimited by an outline which matches the shape of a flap-shaped support (14) which has cradles (13*f*) that accommodate the hinge pins (14*a*) of said flap. Inside the space defined by the seat, there is a partially emerging slot (13*c*) which is substantially horizontal from front to back and provides a gap through which the end piece can pass. Flap-shaped support (14) has a guide path (14*b*) defined by an oblong slot (14*c*) in its thickness with longitudinal fins (14*d*) which form guide rails. The rear surface (14*e*) has a recess (14*f*) forming a seat for spring (15) which rests against the opposite-facing surface of the side piece.

Figure 13:
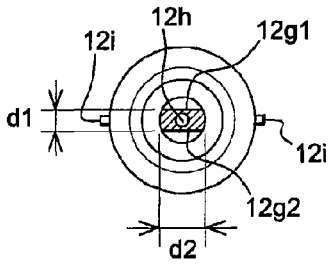
FIG. 13 is a cross-sectional view along line A-A in FIG. 12.

The special configuration of the end piece, shown in FIGS. 12 and 13, enables cooperation with the above-mentioned device, especially a maximum constriction equal to a distance between the guide fins of 1.5, to 2, cm, so that it is only possible to insert section (d1) of the end piece in one direction, given the fact that its section (d2) in one plane differs from that (d2) in the other plane. Indeed, raised or other types of guide marks (12*i*) can be provided on the end piece to show the direction in which it is inserted into the flap-shaped support. In addition and according to a specific feature of the above-mentioned support, the end of oblong slot (14*e*) has a round recess (14*g*) which matches the profile of the head of the end piece.

As shown in FIGS. 15 and 16, when the end piece is fitted in the articulated flap-shaped support, spring (15) is compressed and the support is in contact with the receiving support side piece. When it reaches the end of its travel, the head of the end piece fits into round recess (14*g*) and the end piece is locked due to expansion of the spring.

The end piece, together with the core of the roll, is removed under the conditions described above and doing so damages it by deforming the head.

This alternative embodiment of the end piece offers a specific advantage thanks to the differentiated section of hollowed-out area (12*g*) which is intended, by specifically designing the flap-shaped support, to prevent any use of competitors' end pieces which are thus incapable of being inserted into the above-mentioned support because of their inappropriate configuration and section.

The solution provided by the Applicant appears simple to implement but choosing this solution is not at all obvious, given the original problem to be solved. There are many manufacturers of apparatus for dispensing wiping material throughout the world and considerable quantities of several hundred million rolls of wiping material are used every year.

The invention claimed is:

1. In apparatus for dispensing wiping material, the combination of an end piece for a roll of wiping material and a support guide for receiving the end piece and mounting the roll in the apparatus, the end piece comprising: a cylindrical bearing surface tightly fitted into a core that supports the roll, with a transverse flange that protrudes from the cylindrical bearing surface and rests against an opposite-facing surface of the core and the roll, and an axially extending neck that has a head and a hollowed-out reduced diameter section forming a guide groove, said hollowed-out section being located between the head and the cylindrical bearing surface, the support guide comprising a slot for insertion of the end piece into the guide, a protruding portion defining an opening that corresponds to and receives the hollowed-out section of the end piece with the head being situated on an opposite side of the protruding portion than the cylindrical bearing surface, and means for preventing extraction of the end piece along the slot, wherein the head and part of the hollowed-out section are deformable and internally provided with a hole that creates deliberate fragility to deform the head and the part by crushing when the head is displaced through the opening, the crushing forcing walls of the head to permanently move toward each other without breaking as the core and the end piece are extracted from the guide, and wherein said head is, in its final state after the core and end piece have been extracted, irreversibly deformed and not reusable in the support guide.

2. The combination as claimed in claim 1, wherein a front surface of the head of the end piece has partial cuts in its thickness in the form of a cross in order to facilitate bending and deformation of the head of the end piece in order to make the head deliberately more fragile.

3. The combination as claimed in claim 1, wherein the hollowed-out section has two opposite facing constrictions which define sections having different thicknesses in planes that are perpendicular to each other.

4. The combination as claimed in claim 3, wherein the opposite-facing constrictions have a curved configuration.

5. The combination as claimed in claim 3, further comprising raised guide marks in alignment with the sections.

6. The combination as claimed in claim 3, wherein the support guide comprises a flap-shaped support located on one side piece of the apparatus which receives the roll of wiping material, an inside part of said side piece having a seat-shaped part provided with cradles that accommodate hinge pins formed on the support, and a slot which defines a gap through which the end piece can pass, wherein the support has a guide path which allows the end piece to move into position using a section which matches a shape of a constriction, wherein a rear surface of the support has a recess to accommodate a return spring which presses against an opposite-facing surface of the side piece, and wherein an end of an oblong slot, defined by the guide path, has a round recess to accommodate the head of the end piece due to the effect of expansion of the return spring after the end piece is fully engaged.

7. The combination as claimed in claim 1, wherein said hole extends internally from an exterior end face of said head and terminates at an interior end location within said part, and a diameter of said hole at said interior end location is no greater than a diameter of said hole at said exterior end face.

* * * * *